US011617934B2

(12) United States Patent
Shirley

(10) Patent No.: US 11,617,934 B2
(45) Date of Patent: Apr. 4, 2023

(54) AUTO FEED HOCKEY PUCK PASSING MECHANISM

(71) Applicant: Robert M. Shirley, Fairfield, CA (US)

(72) Inventor: Robert M. Shirley, Fairfield, CA (US)

( * ) Notice: Subject to any disclaimer, the term of this patent is extended or adjusted under 35 U.S.C. 154(b) by 0 days.

(21) Appl. No.: 16/945,699

(22) Filed: Jul. 31, 2020

(65) Prior Publication Data

US 2021/0038965 A1 Feb. 11, 2021

Related U.S. Application Data

(60) Provisional application No. 62/884,040, filed on Aug. 7, 2019.

(51) Int. Cl.
*A63B 69/00* (2006.01)
*A63B 69/40* (2006.01)

(52) U.S. Cl.
CPC ..... *A63B 69/408* (2013.01); *A63B 69/0026* (2013.01); *A63B 2225/093* (2013.01)

(58) Field of Classification Search
CPC ..... A63B 69/408; A63B 69/407; A63B 69/40; A63B 69/401; A63B 69/0026; F41J 9/18; F41J 9/20; F41J 9/24; F41J 9/30
USPC ..... 124/16, 45, 82, 4, 6, 7, 8
See application file for complete search history.

(56) References Cited

U.S. PATENT DOCUMENTS 2,925,812 A * 2/1960 Foster ..... F41J 9/20 124/8
3,070,082 A * 12/1962 Foster ..... F41J 9/20 124/8
3,665,910 A * 5/1972 Boni ..... A63B 69/0026 124/73
3,677,257 A * 7/1972 Segerkvist ..... F41J 9/30 124/43
3,822,688 A 7/1974 Mayne
3,841,293 A * 10/1974 Laporte ..... F41J 9/30 221/297

(Continued)

FOREIGN PATENT DOCUMENTS

CA 1221593 * 5/1987 ..... A63B 47/002
CA 1221593 A 5/1987

OTHER PUBLICATIONS

Champion Traps and Targets: Wheelybird auto-feed trap; 22 pages; retrieved from the internet (https://www.championtarget.com/on/demandware.static/-/Library-Sites-HuntShootAccessoriesSharedLibrary/default/dwa8e5f63 2/productPdfFiles/championPdf/CT879_40909_WheelyBird_Instructions_1LIMv2_rev1 10617_web.pdf) on Aug. 10, 2020.

(Continued)

*Primary Examiner* — John E Simms, Jr.
(74) *Attorney, Agent, or Firm* — Parsons Behle & Latimer

(57) ABSTRACT

A device for automatically launching hockey pucks includes a vertical holder, a throwing arm, a spring, and a base. The vertical holder is configured to hold a plurality of hockey pucks therein. The throwing arm is positioned underneath the vertical holder and configured to rotate. The spring is connected to the rotating throwing arm and configured to accelerate the rotation of the arm so as to launch a hockey puck of the plurality of hockey pucks off of the arm at a rate of 10-40 mph. The base is configured to support the vertical holder, the throwing arm, and the spring such that the hockey puck is launched substantially horizontally.

20 Claims, 6 Drawing Sheets

(56) References Cited

U.S. PATENT DOCUMENTS 3,876,201 A * 4/1975 King ..... A63B 69/40 473/446
3,923,033 A * 12/1975 Laporte ..... F41J 9/24 124/8
5,069,451 A * 12/1991 Martens ..... A63B 47/002 124/79
5,605,139 A 2/1997 Orwoll
6,159,112 A * 12/2000 Ciluffo ..... A63B 69/0026 124/4
6,691,691 B1 * 2/2004 Beynon ..... A63B 69/407 124/16
7,662,054 B2 2/2010 Erickson
8,381,709 B2 * 2/2013 Woessner ..... A63B 69/40 124/7
8,469,841 B1 6/2013 Giauque et al.
8,677,983 B2 3/2014 Callander et al.
8,899,216 B2 12/2014 Laporte et al.
8,919,331 B2 12/2014 Rennert
9,004,055 B2 4/2015 Laporte et al.
D728,714 S 5/2015 Sotheran
9,052,169 B2 6/2015 Laporte et al.
9,057,589 B2 6/2015 Laporte et al.
9,061,217 B2 6/2015 Strauss
9,067,118 B2 6/2015 Colding-Kristensen
9,067,119 B1 6/2015 Vaught et al.
9,086,257 B2 7/2015 Laporte et al.
9,120,025 B2 9/2015 Hudson et al.
9,163,913 B2 10/2015 Laporte et al.
9,186,566 B2 11/2015 Boehner
9,199,154 B2 12/2015 Kroll
9,259,631 B2 2/2016 Gowan et al.
9,289,667 B2 3/2016 Niskanen
9,303,942 B2 4/2016 Sievers
9,341,446 B2 5/2016 Dennison
9,389,049 B2 7/2016 Hoetger
9,389,050 B1 * 7/2016 Chen ..... F41J 9/30
D765,194 S 8/2016 Tamnstrom et al.
9,446,297 B2 9/2016 Darmon
D769,998 S 10/2016 Preston
D771,761 S 11/2016 McKinney et al.
9,605,931 B2 3/2017 Laporte et al.
9,636,561 B2 5/2017 Simon
D789,466 S 6/2017 Cho et al.
9,687,750 B2 6/2017 Rossi et al.
D794,729 S 8/2017 Johnson
9,731,210 B2 8/2017 Lennon
D796,596 S 9/2017 Setty
D798,400 S 9/2017 Boni
9,750,988 B1 9/2017 Auld et al.
D801,456 S 10/2017 Simon
9,835,421 B2 12/2017 Laporte
9,914,041 B2 3/2018 Vorozilchak
9,943,739 B2 4/2018 Hart
9,981,174 B1 5/2018 Decilveo et al.
D820,923 S 6/2018 Johnson
10,052,544 B2 8/2018 Gowan et al.
D827,740 S 9/2018 Withers
10,076,695 B1 9/2018 Simon
10,112,095 B2 10/2018 Serowik
10,112,096 B1 10/2018 Taylor et al.
10,179,270 B2 1/2019 Larose
10,195,503 B1 2/2019 Lesh
10,245,490 B2 4/2019 Bulloch
10,247,511 B2 4/2019 Malarkey
10,272,311 B2 4/2019 Bear
10,315,090 B2 6/2019 Campbell
10,322,328 B1 6/2019 Hart
10,323,914 B2 6/2019 Müller et al.
10,350,473 B2 7/2019 Cupa
10,365,072 B1 7/2019 Liu
10,391,376 B2 8/2019 Guise
10,406,417 B1 * 9/2019 Le Tourneau ..... A63B 71/0622
10,746,513 B1 * 8/2020 Liu ..... F41J 9/20
2006/0065258 A1 * 3/2006 Lovell ..... F41J 9/30 124/9
2015/0168108 A1 * 6/2015 Laporte ..... F41J 9/24 124/7
2016/0361620 A1 * 12/2016 Vorozilchak ..... A63B 69/0026
2017/0052003 A1 * 2/2017 Liu ..... F41J 9/18
2017/0176151 A1 * 6/2017 Liu ..... F41J 9/18

OTHER PUBLICATIONS

Champion Traps and Targets; Workhorse auto-feed trap; 24 pages; retrieved from the internet (https://s7d2.scene7.com/is/content/academy/1805764) on Aug. 10, 2020.

* cited by examiner

AUTO FEED HOCKEY PUCK PASSING MECHANISM

CROSS REFERENCE TO RELATED APPLICATIONS

This application claims priority to U.S. Patent Provisional Application No. 62/884,040, filed on Aug. 7, 2019, the entirety of which is incorporated by reference herein.

INCORPORATION BY REFERENCE

All publications and patent applications mentioned in this specification are herein incorporated by reference to the same extent as if each individual publication or patent application was specifically and individually indicated to be incorporated by reference.

BACKGROUND

A device that can simulate passing or shooting of a hockey puck has the potential to greatly increase the efficiency of hockey practice. However, there is currently no available device that reliably simulates the trajectory and speed of passing/shooting a hockey puck, is cost effective, and is suitable for both personal and professional use. An auto feed hockey puck passing mechanism that addresses these deficiencies is described herein.

SUMMARY OF THE DISCLOSURE

In general, in one embodiment, a device for automatically launching hockey pucks includes a vertical holder, a throwing arm, a spring, and a base. The vertical holder is configured to hold a plurality of hockey pucks therein. The throwing arm is positioned underneath the vertical holder and configured to rotate. The spring is connected to the rotating throwing arm and configured to accelerate the rotation of the arm so as to launch a hockey puck of the plurality of hockey pucks off of the arm at a rate of 10-40 mph. The base is configured to support the vertical holder, the throwing arm, and the spring such that the hockey puck is launched substantially horizontally.

This and other embodiments can include one or more of the following features. The vertical holder can be configured to hold 50 hockey pucks or less. The throwing arm can be configured to continuously rotate within a horizontal plane. The spring can have a weight rating of 4-50 lbs/inch.

The device can be configured to launch a hockey puck of the plurality of hockey pucks once every 1-10 seconds. The device can further include an automatic feeding mechanism configured to feed the plurality of hockey pucks from the vertical holder to the throwing arm. The automatic feeding mechanism can be configured to feed the plurality of hockey pucks to the throwing arm at a rate of once every 1-10 seconds. The automatic feeding mechanism can include a drop hole opening in the base and a sliding plate. The sliding plate can be configured to open to pass a hockey puck through the drop hole opening. The automatic feeding mechanism can further include a retracting spring configured to close the sliding plate. The retracting spring can have a weight rating of 5-10 lbs/inch. The automatic feeding mechanism can further include a cam, a pin, and a rotor. The cam can be configured to rotate with the throwing arm and to engage with the pin and rotor to open the sliding plate. The automatic feeding mechanism can further include a spring-loaded retainer pin configured to hold the plurality of pucks within the vertical holder so that only a single puck drops through the drop hole opening onto the throwing arm when the sliding plate is opened. The spring-loaded retainer pin can have a weight rating of 5-15 lbs/inch. The spring-loaded retainer pin can be positioned 1-2 inches above the drop hole opening. A rate at which the plurality of hockey pucks are launched can be configured to be adjustable by a user. The device can further include an electric motor configured to rotate the throwing arm. The rate at which the hockey pucks are launched off of the arm can be adjustable by a user. The throwing arm can be configured to be positioned 8 to 10 inches off of a ground on which the base is positioned. An angle of launch of the hockey puck can be adjustable by a user from the substantially horizontal position to an angled position. The angled position can be adjustable up to 30 degrees relative to horizontal.

BRIEF DESCRIPTION OF THE DRAWINGS

The novel features of the invention are set forth with particularity in the claims that follow. A better understanding of the features and advantages of the present invention will be obtained by reference to the following detailed description that sets forth illustrative embodiments, in which the principles of the invention are utilized, and the accompanying drawings of which:

FIG. 5B is a close-up of a portion of the mechanism in FIG. 5A.

DETAILED DESCRIPTION

Described herein is an automatic hockey puck passing mechanism that can continuously shoot hockey pucks horizontally at approximately 10-40 mph, such as 15-25 mph. The automatic hockey puck passing machine can advantageously simulate a puck that has been passed or shot at the trajectory and speed of a human-passed or human-shot hockey puck.

Figure 1A:
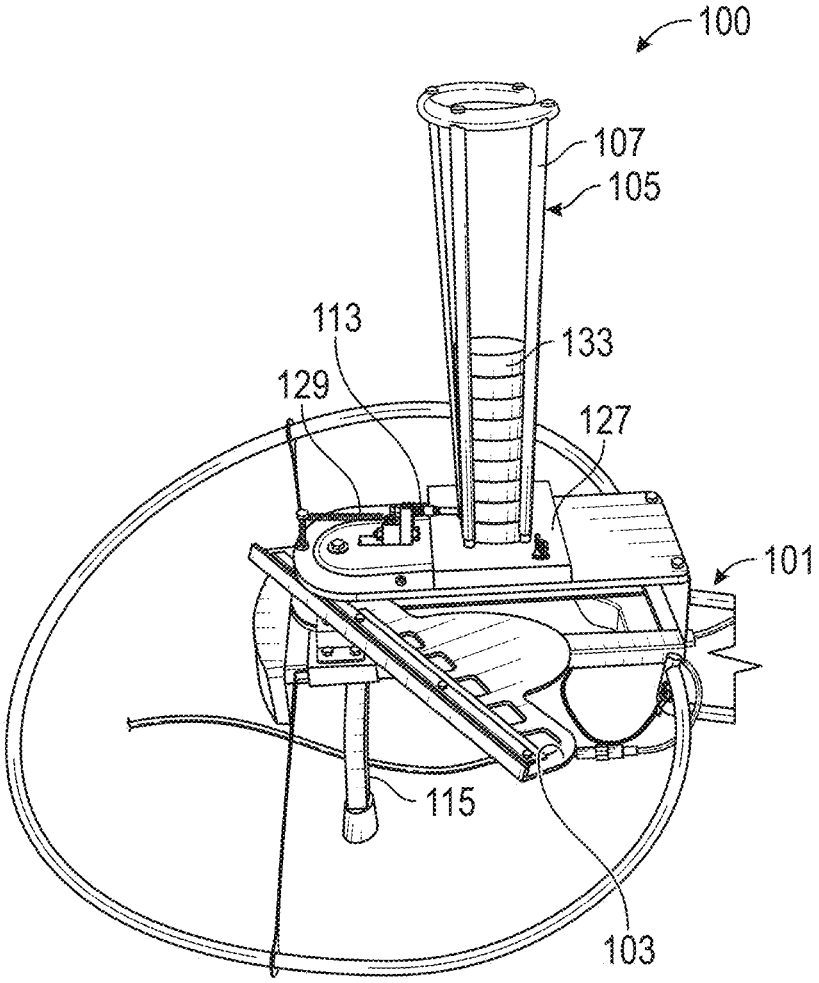
FIGS. 1A and 1B show a hockey puck passing mechanism with the throwing arm partially cocked.

Referring to FIG. 1A, the hockey puck passing mechanism 100 can include a base 101, a throwing arm 103, and a vertical holder 105. The base 101 can include a plurality of legs 115 to support the puck passing mechanism 100. The legs 115 can have a length and position such that the throwing arm 103 is positioned substantially horizontally (i.e., substantially parallel to the ground), thereby allowing the hockey pucks 133 to be launched horizontally from the arm 103 just above the ground (e.g., ice), such as 5-15", such as 8-12", such as 9-11", such as approximately 10" off of the ground. Because the pucks 133 are launched horizontally just above the ground, the pucks can quickly land and slide horizontally along the ground, similar to a human-passed or human-shot puck. Further, the vertical holder 105 can be configured to hold 50 hockey pucks 133 or less, such as 40 hockey pucks or less, such as 25 hockey pucks or less.

Figure 1B:
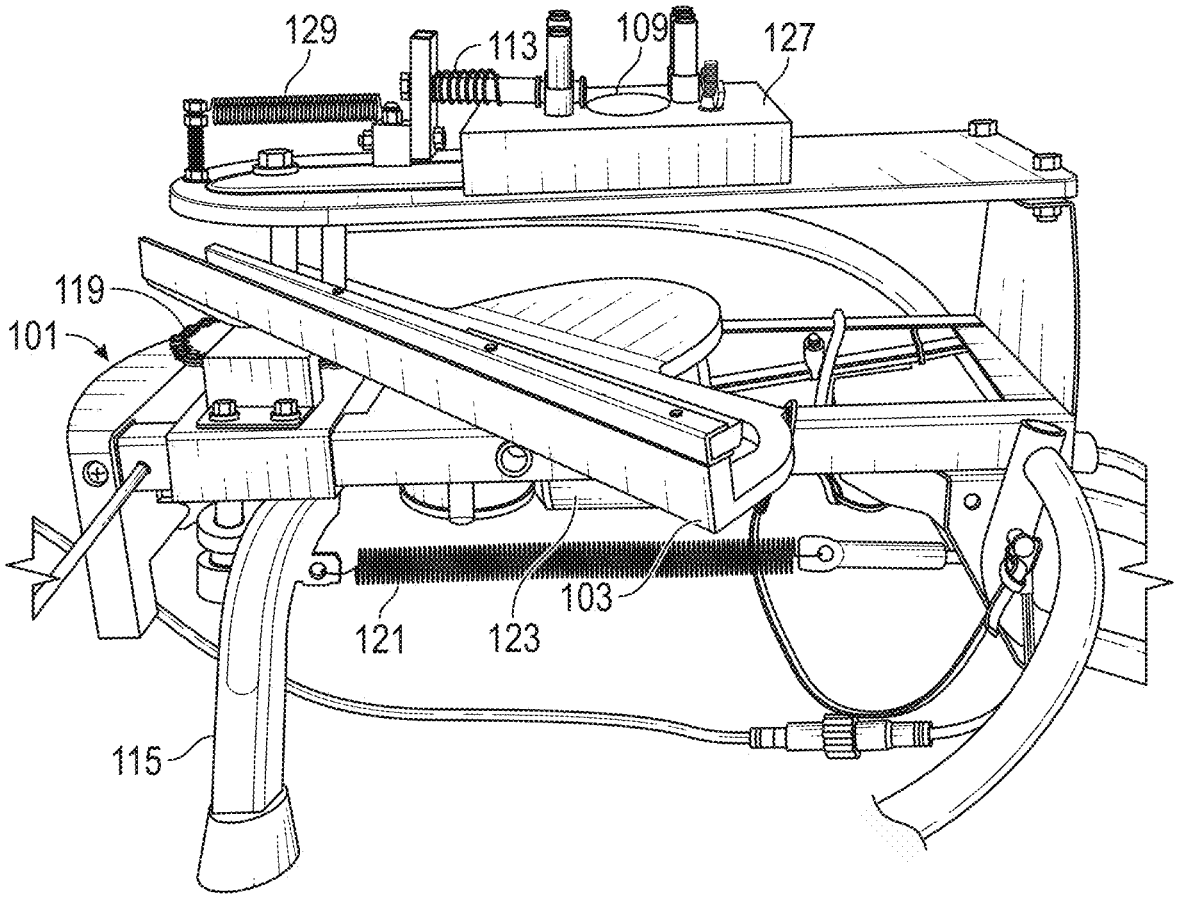
Figure 2:
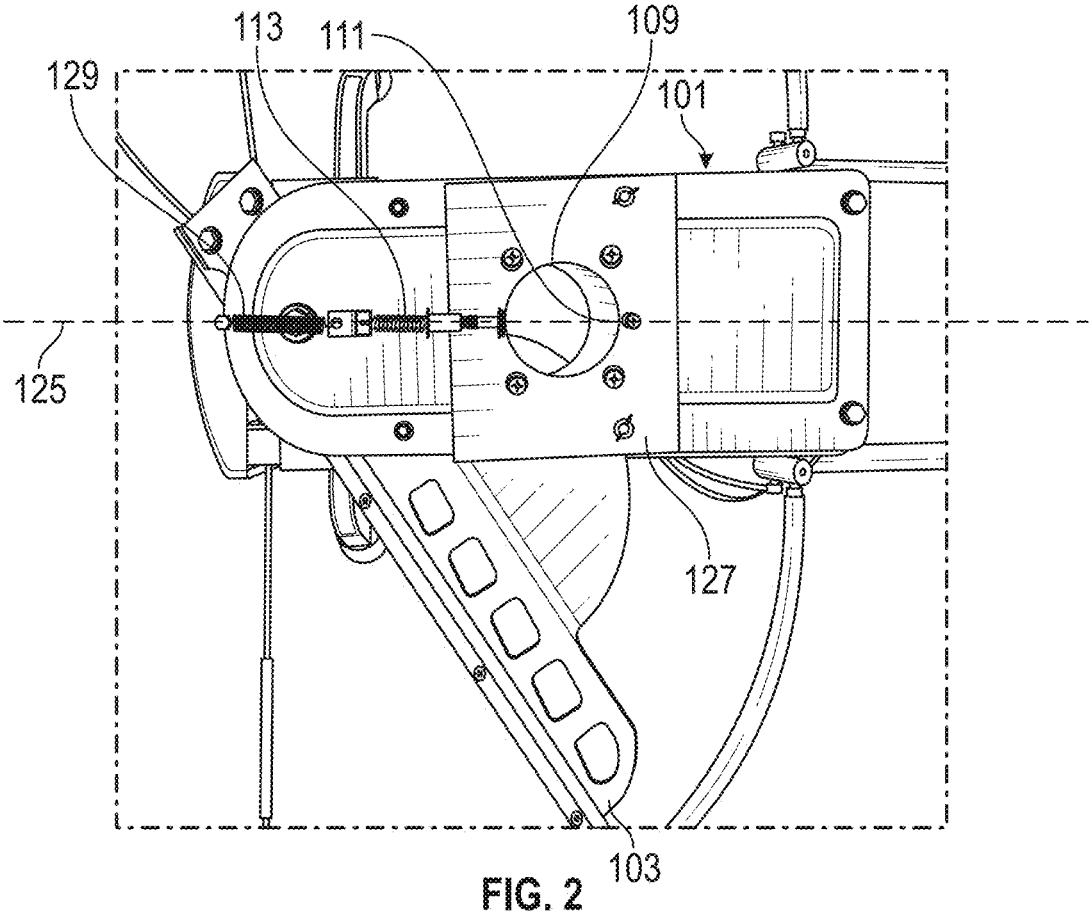
FIG. 2 shows the hocking puck passing mechanism with the throwing arm partially cocked, but rotated further counterclockwise relative to the position shown in FIGS. 1A and 1B.
Figure 3:
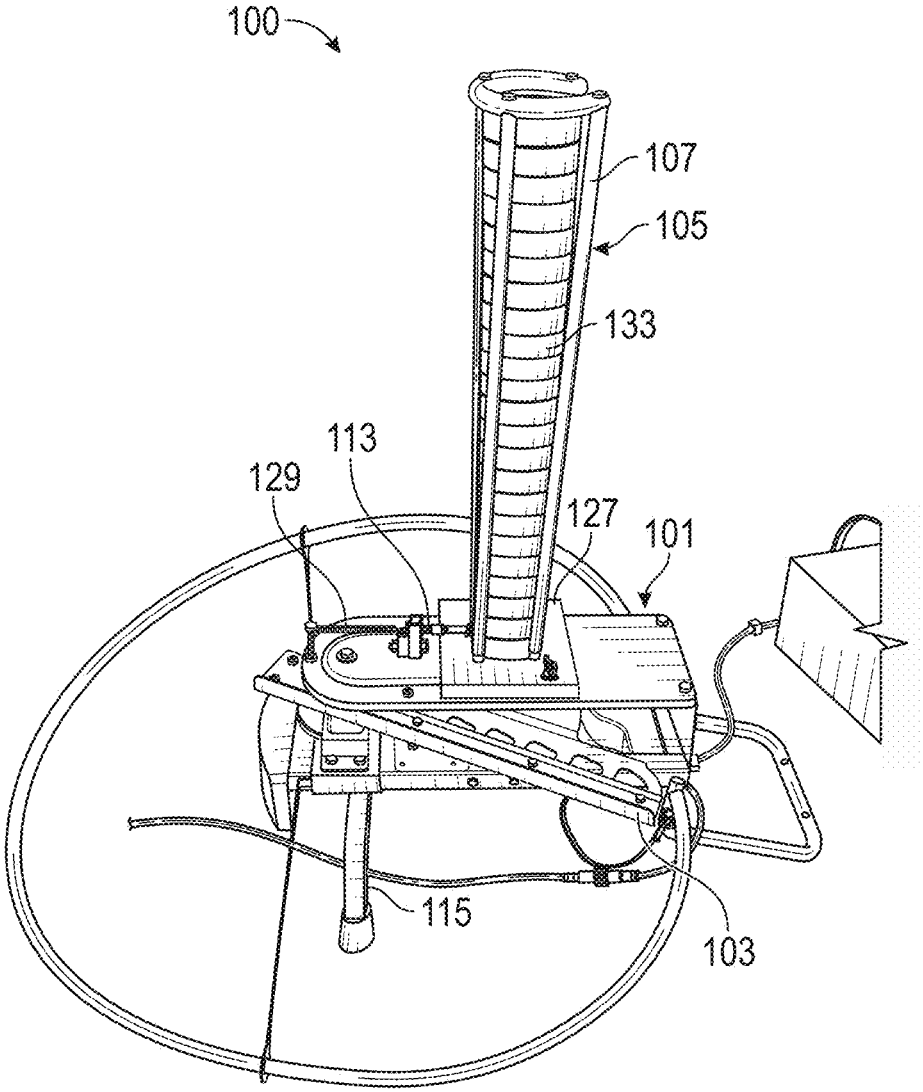
FIG. 3 shows the hockey puck passing mechanism with the throwing arm partially cocked, but rotated further counterclockwise relative to the position shown in FIG. 2.
Figure 4:
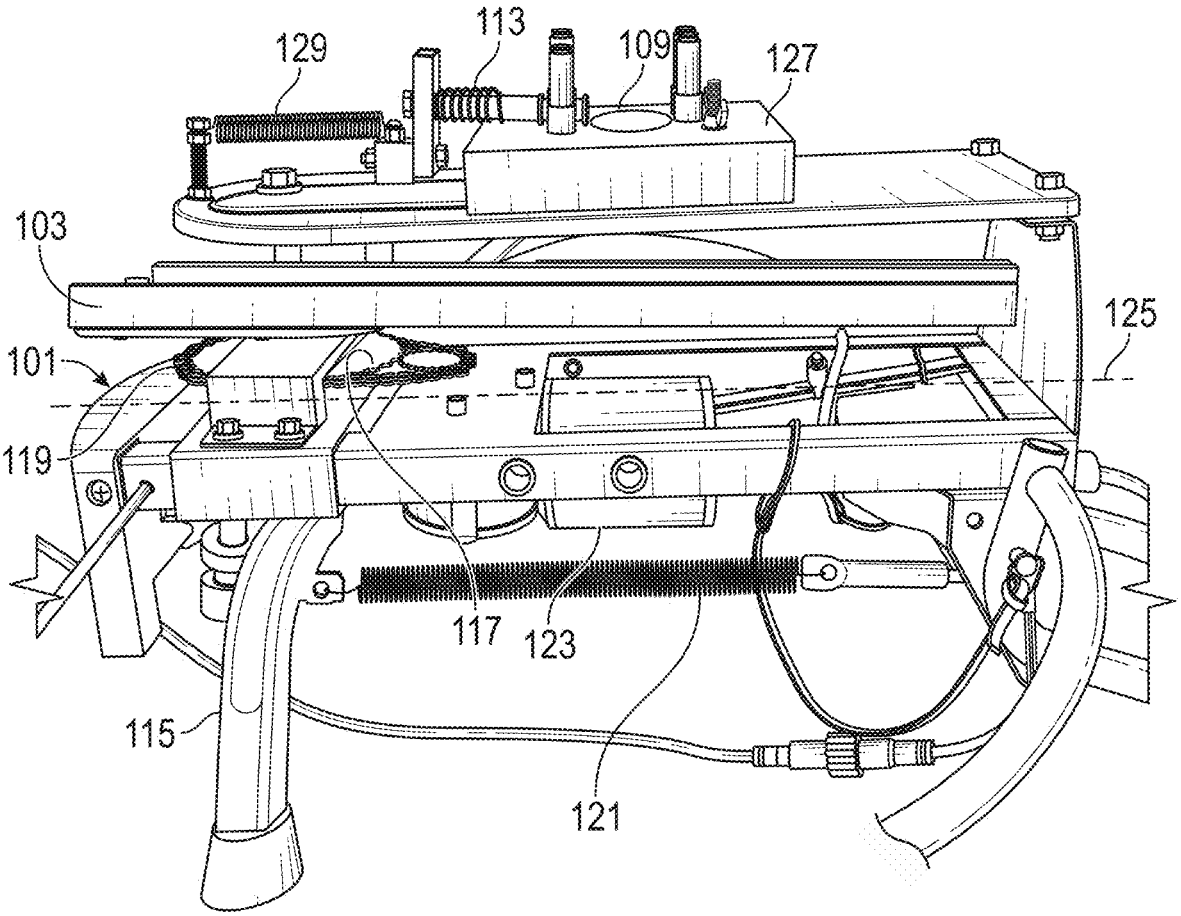
FIG. 4 shows the hockey puck passing mechanism with the throwing arm fully cocked.
Figure 5A:
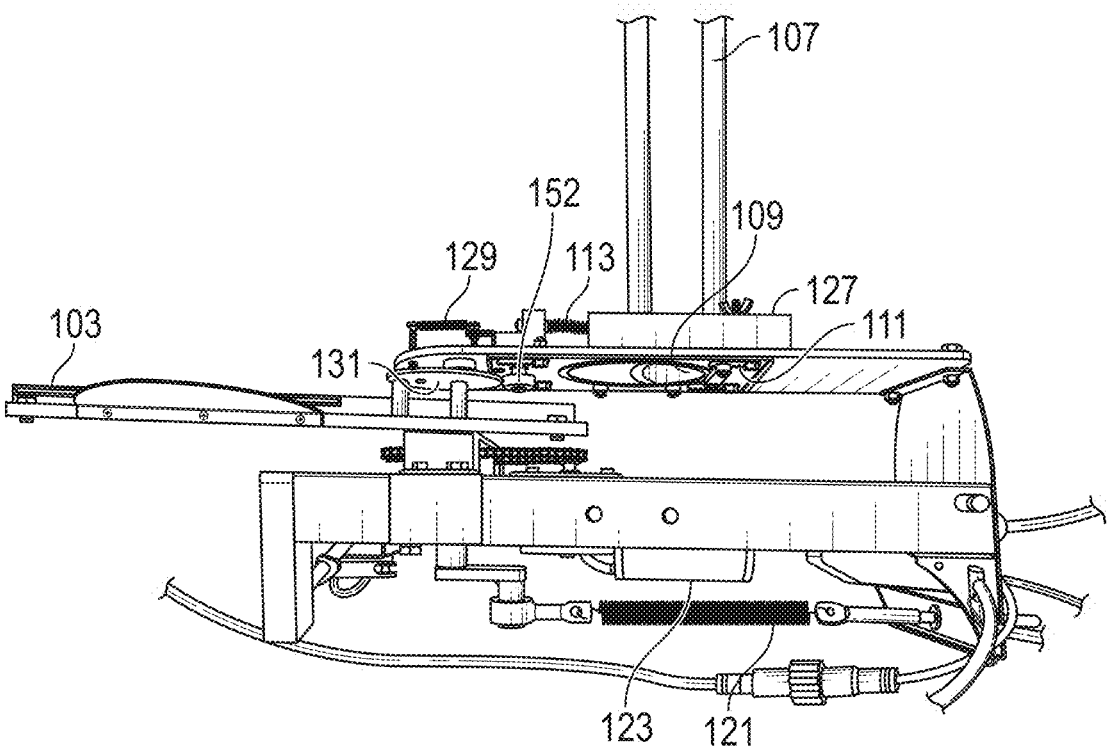
FIGS. 5A and 5B show the hocking puck passing mechanism with the throwing arm in the uncocked position, where
Figure 5B:
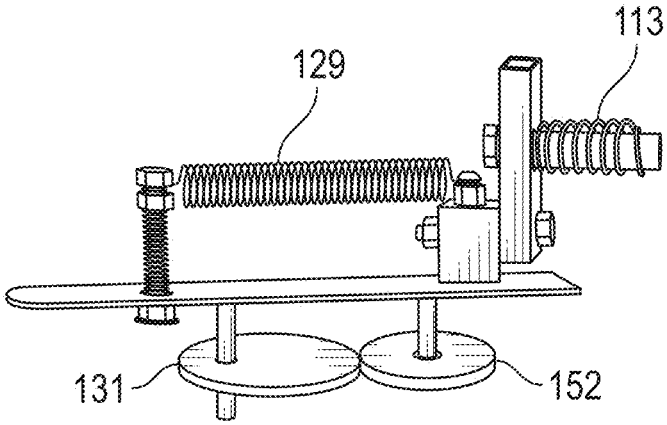

The throwing arm 103 can be configured to continuously rotate within the horizontal plane in single direction (e.g., counterclockwise) so as to repeatedly accelerate and launch hockey pucks 133 using centripetal force and rotational moment. The rotation of the throwing arm 103 to launch a hockey puck 133 is shown sequentially in FIGS. 1A and 1B through 5. To activate the throwing arm 103, an electric motor 123 can drive gears 117 and a chain 119 to power the throwing arm 103 counterclockwise. The throwing arm 103 can be attached to a spring 121, which can have a weight rating of 5-40 lbs/inch, such as 8-20 lbs/inch, such as approximately 11 lbs/inch. When the throwing arm 103 is partially cocked (and just off of the central longitudinal axis 125 as shown in FIGS. 1A and 1B), the spring 121 can have a relatively low load (with the minimal load occurring when the arm 103 is in the uncocked position shown in FIGS. 5A and 5B). As the throwing arm 103 rotates further counterclockwise (as shown sequentially in FIGS. 2-3) and closer to the central longitudinal axis 125 and the fully cocked position (shown in FIG. 4), the spring 121 can become further stretched/loaded. The spring 121 can be at a maximum extension and load when the throwing arm 103 is fully cocked, positioned fully within the base 101, and aligned along the central longitudinal axis 125 of the mechanism 100 (as shown in FIG. 4). As the throwing arm 103 is advanced counterclockwise just past the fully cocked position along the central longitudinal axis 125, the tension from the spring 121 can cause the throwing arm 103 to rapidly accelerate counterclockwise, launching a hockey puck 133 positioned on top of the arm 103 horizontally (i.e., as the arm 103 rotates 180 degrees from the cocked positioned shown in FIG. 4 to the uncocked position shown in FIGS. 5A and 5B). The hockey puck can be launched by the throwing arm 103 at approximately 10-40 mph, such as 15-30 pmh, such as approximately 20 mph.

Pucks 133 from the vertical holder 105 can be continuously provided to the arm 103 (i.e., one puck can be fed onto the arm 103 via gravity each time that the arm 103 makes a full 360° rotation) so as to provide continuous launching of hockey pucks by the arm 103. In some embodiments, the pucks 133 can be launched at a rate of approximately 1 hockey puck every one to ten seconds, such as once every two seconds. The vertical holder 105 can include a plurality (e.g., four) of vertical elements 107 (e.g., metal tubes) that are spaced substantially equidistant (e.g., at a diagonal of 3.125") apart to allow three inch diameter hockey pucks to drop (and/or be stored) vertically therebetween. In some embodiments, the vertical holder 105 can further include a block 127, such as an acrylic block, to which the vertical elements 107 are attached. In one specific embodiment, the block 127 can be a 6" by 6" by 1" block. Further, the vertical holder 105 can be positioned above a drop hole opening 109 in the base 101, which can be configured to allow a puck to pass therethrough onto the throwing arm 103. A sliding plate 111 (e.g., a metal plate) can be positioned adjacent to and directly under the drop hole opening 109 so as to at least partially cover or close the drop hole opening 109. As the throwing arm 103 advances, the ovoid-shaped cam 131 (which is mounted off-center) can rotate. At a set rotation of the arm 103, the elongated side of the ovoid cam 131 can engage with a pin and roller 152 that is attached to the sliding plate 111. Further rotating the cam 131 can therefore cause the pin and roller 152 to advance the sliding plate 111 to completely open the drop hole 109 and allow the bottom hockey puck 133 from the vertical holder 105 to drop onto the throwing arm 103 for launch as described above. After launch, the cam 131 can disengage from the pin and roller 152, and the retracting spring 129 can retract the sliding plate 111 to partially cover or close the drop hole opening 109 and prevent additional pucks 133 from dropping onto the throwing arm 103 until the process is repeated. In some embodiments, the retracting spring 129 can have a weight rating of 5-10 lbs/inch, such as approximately 7 lbs/inch.

A spring-loaded retainer pin 113 (e.g., with a weight rating of 5-15 lbs/inch, such as 9-13 lbs/inch) such as approximately 11 lbs/inch) can be configured to hold additional pucks 133 within the vertical holder 105 so that only a single puck drops through the drop hole opening 109 onto the throwing arm 103 when the sliding plate 111 is advanced. In some embodiments, the retainer pin 113 can be 1"-2", such as 1.25" above the top of the drop hole opening 109. Advantageously, this height ensures that the retainer pin 113 aligns with the second puck 133 in the stack (while allowing only the first or bottom puck 133 to fall). As the arm 103 goes through another full rotation, an additional puck from the vertical holder 105 can be released. The process can be repeated until all of the pucks in the vertical holder 105 have been launched.

In one specific embodiments, the hockey puck passing mechanism 100 can be configured, for example, to hold up to 25 hockey pucks that are solid rubber, 3" in diameter, 1" thick, and 3 oz in weight.

In some embodiments, the rate at which the hockey pucks 133 are released by the arm 103 can be varied by the user. For example, the rate can be varied between 1 hockey puck per second to 1 hockey puck per 10 seconds. In one embodiment, the voltage applied to the electric motor 123 can be varied to increase or decrease the rate at which the hockey pucks 133 are released by the arm 103. For example, the voltage can be varied between 5-20 volts, such as between 10-15 volts. In one specific embodiment, the electric motor 123 can operate at approximately 12 volts to release one hockey puck every two seconds.

In some embodiments, the speed of the hockey pucks 133 at launch can be varied by the user. For example, the speed can be varied between 10-40 mph. In one embodiment, the spring 121 can be adjusted (e.g., tightened or loosened) so as to increase or decrease the rate at which the hockey pucks are released by the arm 103.

In some embodiments, the angle of launch of the hockey pucks 133 can be varied by the user. For example, the angle of launch can be adjusted between 0 degrees and 30 degrees, such as between 10 degrees and 20 degrees. In some embodiments, the legs 115 can have an adjustable height to change the angle of launch. For example, the front legs 115 (i.e., the legs 115 towards the launch direction) can be positioned up to 20" off of the ground.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Terminology used herein is for the purpose of describing particular embodiments only and is not intended to be limiting of the invention. For example, as used herein, the singular forms "a", "an" and "the" are intended to include the plural forms as well, unless the context clearly indicates otherwise. It will be further understood that the terms "comprises" and/or "comprising," when used in this specification, specify the presence of stated features, steps, operations, elements, and/or components, but do not preclude the presence or addition of one or more other features, steps, operations, elements, components, and/or groups thereof. As used herein, the term "and/or" includes any and all combinations of one or more of the associated listed items and may be abbreviated as "/".

Spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal" and the like are used herein for the purpose of explanation only unless specifically indicated otherwise.

Although the terms "first" and "second" may be used herein to describe various features/elements (including steps), these features/elements should not be limited by these terms, unless the context indicates otherwise. These terms may be used to distinguish one feature/element from another feature/element. Thus, a first feature/element discussed below could be termed a second feature/element, and similarly, a second feature/element discussed below could be termed a first feature/element without departing from the teachings of the present invention.

Throughout this specification and the claims which follow, unless the context requires otherwise, the word "comprise", and variations such as "comprises" and "comprising" means various components can be co-jointly employed in the methods and articles (e.g., compositions and apparatuses including device and methods). For example, the term "comprising" will be understood to imply the inclusion of any stated elements or steps but not the exclusion of any other elements or steps.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Although various illustrative embodiments are described above, any of a number of changes may be made to various embodiments without departing from the scope of the invention as described by the claims. For example, the order in which various described method steps are performed may often be changed in alternative embodiments, and in other alternative embodiments one or more method steps may be skipped altogether. Optional features of various device and system embodiments may be included in some embodiments and not in others. Therefore, the foregoing description is provided primarily for exemplary purposes and should not be interpreted to limit the scope of the invention as it is set forth in the claims.

The examples and illustrations included herein show, by way of illustration and not of limitation, specific embodiments in which the subject matter may be practiced. As mentioned, other embodiments may be utilized and derived there from, such that structural and logical substitutions and changes may be made without departing from the scope of this disclosure. Such embodiments of the inventive subject matter may be referred to herein individually or collectively by the term "invention" merely for convenience and without intending to voluntarily limit the scope of this application to any single invention or inventive concept, if more than one is, in fact, disclosed. Thus, although specific embodiments have been illustrated and described herein, any arrangement calculated to achieve the same purpose may be substituted for the specific embodiments shown. This disclosure is intended to cover any and all adaptations or variations of various embodiments. Combinations of the above embodiments, and other embodiments not specifically described herein, will be apparent to those of skill in the art upon reviewing the above description.

What is claimed is:

1. A device for automatically launching hockey pucks, the device comprising:

a single vertical holder configured to hold a plurality of hockey pucks therein;

a throwing arm having a proximal end, a distal end and a semi-circular surface spaced apart from the proximal end and the distal end, the semi-circular surface sized to receive a hockey puck, wherein in operation when the throwing arm is positioned underneath the vertical holder such that a hockey puck existing the vertical holder lands on the semi-circular surface, the throwing arm configured to rotate;

a spring connected to the throwing arm, the spring configured to accelerate the rotation of the throwing arm so as to launch a hockey puck of the plurality of hockey pucks off of the semi-circular surface at a speed of 10-40mph; and a base configured to support the vertical holder, the throwing arm, and the spring such that the hockey puck is launched substantially horizontally from the semi-circular surface at a height from 5 inches to 15 inches above a surface supporting the base.

2. The device of claim 1, wherein the vertical holder is configured to hold 50 hockey pucks or less.

3. The device of claim 1, wherein the throwing arm is configured to continuously rotate within a horizontal plane.

4. The device of claim 1, wherein the spring has a weight rating of 4-50 lbs/inch.

5. The device of claim 1, wherein the device is configured to launch a hockey puck of the plurality of hockey pucks once every 1-10 seconds.

6. The device of claim 1, further comprising an automatic feeding mechanism configured to feed the plurality of hockey pucks from the vertical holder to the throwing arm.

7. The device of claim 6, wherein the automatic feeding mechanism is configured to feed the plurality of hockey pucks to the throwing arm at a rate of once every 1-10 seconds.

8. The device of claim 6, wherein the automatic feeding mechanism comprises a drop hole opening in the base and a sliding plate, the sliding plate configured to open to pass a hockey puck through the drop hole opening.

9. The device of claim 8, wherein the automatic feeding mechanism further comprises a retracting spring configured to close the sliding plate.

10. The device of claim 9, wherein the retracting spring has a weight rating of 5-10 lbs/inch.

11. The device of claim 8, wherein the automatic feeding mechanism further comprises a cam, a pin, and a rotor, wherein the cam is configured to rotate with the throwing arm and to engage with the pin and rotor to open the sliding plate.

12. The device of claim 8, wherein the automatic feeding mechanism further comprises a spring-loaded retainer pin configured to hold the plurality of pucks within the vertical holder so that only a single puck drops through the drop hole opening onto the throwing arm when the sliding plate is opened.

13. The device of claim 12, wherein the spring-loaded retainer pin has a weight rating of 5-15 lbs/inch.

14. The device of claim 12, wherein the spring-loaded retainer pin is positioned 1-2 inches above the drop hole opening.

15. The device of claim 1, wherein a rate at which the plurality of hockey pucks are launched is configured to be adjustable by a user.

16. The device of claim 1, further comprising an electric motor configured to rotate the throwing arm.

17. The device of claim 1, wherein the speed at which the hockey pucks are launched off the arm is adjustable by a user, wherein the spring is tightened to increase the speed and wherein the spring is loosened to decrease the speed.

18. The device of claim 1, wherein the throwing arm is configured to be positioned 8 to 10 inches off of a ground on which the base is positioned.

19. The device of claim 1, further wherein an angle of launch of the hockey puck is adjustable by a user from the substantially horizontal position to an angled position.

20. The device of claim 19, wherein the angled position is adjustable up to 30 degrees relative to horizontal.

* * * * *